United States Patent [19]

Mueller et al.

[11] Patent Number: 4,771,589

[45] Date of Patent: Sep. 20, 1988

[54] METHOD AND APPARATUS FOR FORMING PACKAGE OF ALTERNATELY INVERTED CONTAINERS

[75] Inventors: Martin J. Mueller, Palm Harbor; Michael A. Weigandt, Duneden, both of Fla.

[73] Assignee: Osgood Industries, Inc., Oldsmar, Fla.

[21] Appl. No.: 100,587

[22] Filed: Sep. 24, 1987

[51] Int. Cl.[4] ..... B65B 35/58; B65B 35/40; B65B 35/44

[52] U.S. Cl. ..... 53/446; 53/448; 53/143; 53/543; 53/544; 198/404

[58] Field of Search ..... 53/143, 543, 544, 446, 53/448; 198/402, 403, 404

[56] References Cited

U.S. PATENT DOCUMENTS

| | | | |
|---|---|---|---|
| 3,143,223 | 8/1964 | McIntyre et al. | 53/143 X |
| 3,596,747 | 8/1971 | Irving, Jr. et al. | 198/404 |
| 3,802,154 | 4/1974 | Dillon | 53/544 X |
| 3,878,665 | 4/1975 | Couten | 53/143 |
| 4,002,005 | 1/1977 | Mueller et al. | 53/543 X |
| 4,192,415 | 3/1980 | Krener et al. | 53/143 X |
| 4,246,739 | 1/1981 | Rogerson | 53/143 X |

*Primary Examiner*—Horace M. Culver

*Attorney, Agent, or Firm*—Dressler, Goldsmith, Shore, Sutker & Milnamow

[57] ABSTRACT

A method and apparatus are disclosed for forming a package of alternately inverted containers, wherein an array of the containers is formed with adjacent containers relatively inverted. In accordance with the invention, a supply of containers is formed into first and second product streams, with each of the containers in the second product stream inverted. The containers are presented by an indexing mechanism to a reciprocating diverting gate mechanism, wherein the forward-most container of each product stream is diverted. In this manner, a pair of further product streams are formed, wherein the containers of each stream are alternately inverted. The containers are subsequently collated for heat-shrink packaging.

12 Claims, 5 Drawing Sheets

METHOD AND APPARATUS FOR FORMING PACKAGE OF ALTERNATELY INVERTED CONTAINERS

TECHNICAL FIELD

The present invention relates generally to arrangements for packaging groups of containers, and more particularly to a method and apparatus for forming a package of containers wherein alternate, adjacent ones of the containers in the package are relatively inverted.

BACKGROUND OF THE INVENTION

A wide variety of consumer food products, such as dairy products and the like, are typically packaged in containers which are configured to nest within one another. Such nestable containers, which typically have a circular, generally tapering configuration, facilitate high-speed packaging of such food products, in that large numbers of the containers can be compactly stored in nested relation within each other in suitable feed magazines. Attendant to product filling, the containers are denested, filled with the desired product, and usually fitted with a lid or like closure to complete filling of the container.

After product filling, it is ordinarily desirable to assemble a group of the containers into a package for subsequent storage, shipment, and eventual retail sale. One type of packaging which has proven particularly desirable is so-called shrink-wrapped packaging. This type of packaging typically employs oriented, heat-shrinkable plastic film material within which the desired group of filled containers is placed, with the film subsequently heated so that it shrinks into conformance with the assembled containers and embraces them to form an integrated package. In this manner, the containers of the package are securely held as they are handled during shipment and storage.

As will be appreciated, it is desirable that containers be assembled in a relatively closely-packaged array for shrink-wrap packaging, thereby lending to the integrity of the finished package, as well as minimizing the required quantity of heat-shrinkable plastic film. Accordingly, it is desirable to arrange nestable containers, wherein opposite ends of each container differ in dimension, in an alternately inverted array, such that each container is relatively inverted relative to the adjacent ones of the containers. In this manner, nestable containers can be arranged in a desirably compact and stable array for heat-shrink packaging.

U.S. Pat. No. 4,002,005, issued Jan. 11, 1977 to Martin Mueller et al., discloses an apparatus which facilitates packaging of nestable containers in alternately inverted arrays. The apparatus of this patent employs a transfer mechanism which is arranged to receive a stream of filled containers, and transfer the containers from one conveyor belt to another while inverting alternate ones of the containers. The containers are subsequently collated into the desired alternately inverted array for subsequent heat-shrink packaging.

Although the apparatus of the above patent provides the desired container packaging, certain disadvantages are associated with its use. Specifically, the transfer mechanisms of the apparatus are supplied with containers at spaced intervals by rotating screw indexing mechanisms. The helical flights of these indexing screws desirably present the upright containers to the transfer mechanisms at spaced intervals, but should a container be missing from between the flights of one of the screws, it must be manually replaced or else containers downstream of the transfer mechanism are not arranged in the proper alternately inverted order. Additionally, the manner in which this previous arrangement conveys containers in an alternately inverted order not only complicates inspection of the containers (such as for damaged containers, over-filled containers, or ones not properly closed), but also requires that any container which must be removed from the line be replaced with another container in the appropriately upright or inverted disposition.

The present invention improves upon previous packaging techniques, and contemplates a method and apparatus for packaging containers which facilitates high-speed operation, correct package formation, and convenient correction of any mispackaging which may occur.

SUMMARY OF THE INVENTION

In accordance with the present invention, a method and apparatus are disclosed which facilitate continuous, high-speed formation of packages of alternately inverted containers. In distinction from previous arrangements, the present invention contemplates that the containers to be packaged are divided into two product streams, with each of the containers in one of the streams inverted. Containers are then substantially simultaneously diverted from the upright and inverted product streams for subsequent collating in an array of containers, wherein each container of the array is relatively inverted with respect to the adjacent containers. Subsequent heat-shrink packaging of the array thus provides a desirably compact and stable package of the containers.

The present apparatus is typically employed downstream of a product filling machine or the like, with the filling machine thus providing a supply of filled containers, ordinarily of the nestable variety. The supply of containers is formed into first and second product streams through the use of first and second product conveyors arranged downstream of the product filling apparatus. The containers are initially conveyed in an upright disposition on both conveyors, thus facilitating visual inspection of the containers, as well as suitable product coding or the like by the use of printing equipment positioned just downstream of the filling apparatus.

While each of the containers in the first product stream is maintained in its normal, upright disposition, each of the containers in the second product stream is inverted through the use of an inverting wheel apparatus operatively associated with the second conveyor. The inverting apparatus is operatively disposed generally between upstream and downstream portions of the second conveyor, and is arranged so as to receive the upright containers from the upstream conveyor portion, and effect inversion of each container and transfer to the downstream conveyor portion. Thus, all of the containers in the second product stream are disposed in an inverted disposition.

The method of the present invention next provides that at least one further product stream is formed wherein the containers of the stream are alternately inverted. To this end, the containers of the first and second product streams are diverted by a reciprocating diverting gate mechanism which is arranged to substantially simultaneously divert the forward-most containers in the first and second product streams. In the preferred practice of the invention, a pair of further product streams are formed, wherein the containers of each further stream are alternately inverted. Notably, the diverting gate mechanism operates such that the containers of each further product stream are alternately inverted in an order opposite that of the other stream.

Packaging of the containers is completed by collating a predetermined number of the alternately inverted containers to form a group or array of the containers, with subsequent heat-shrink packaging preferably effected. When, as in the preferred practice, a pair of further product streams are formed downstream of the diverting gate mechanism, the containers of the oppositely alternating product streams are arranged in a side-by-side array, such that the adjacent containers of the assembled group are all relatively inverted.

Other features and advantages of the present invention will become readily apparent from the following detailed description, the appended drawings, and the accompanying claims.

DETAILED DESCRIPTION

Figure 1:
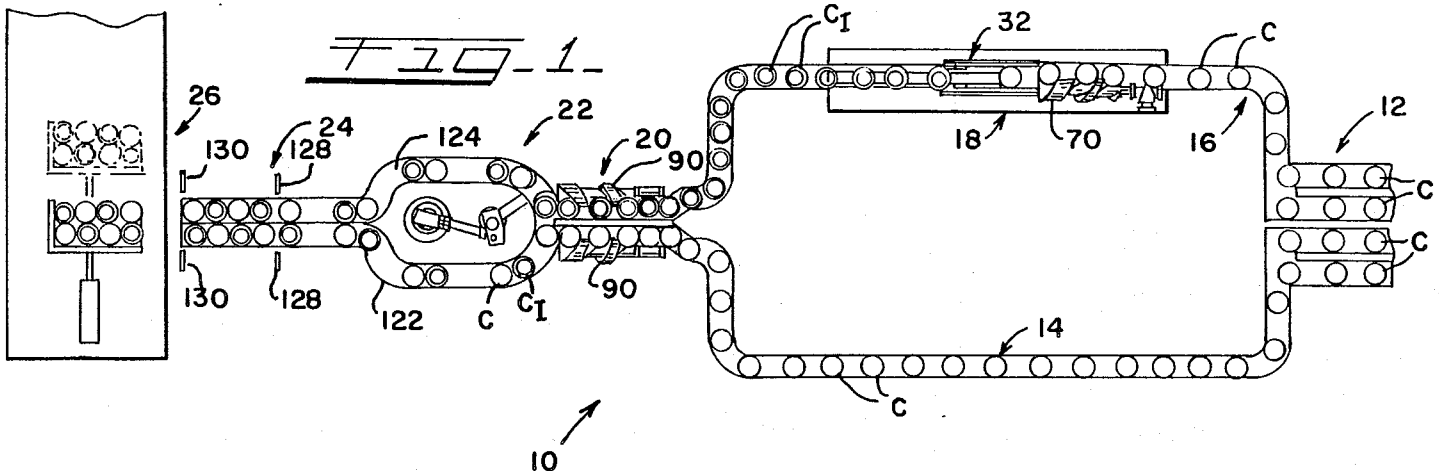
FIG. 1 is a diagrammatic, top plan view of a packaging apparatus embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

Figure 2:
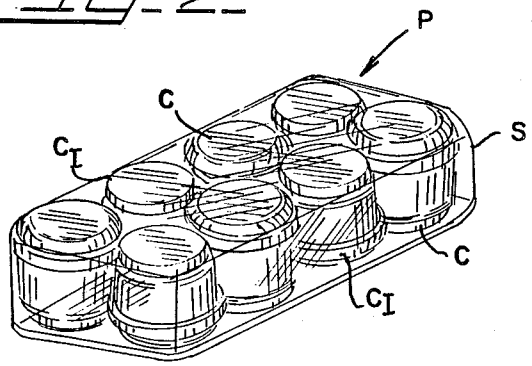
FIG. 2 is a perspective view of a package of alternately inverted, nestables containers of the type which can be formed in accordance with the present method and apparatus.

Referring first to FIGS. 1 and 2, therein is illustrated the packaging apparatus 10 in accordance with the present invention, which is particularly suited for forming a package P of alternately inverted containers. As shown in FIG. 2, the desired package includes adjacent containers C, $C_I$ which are relatively and alternately inverted. After assembly of the containers in the desired alternately inverted array, heat-shrinkable packaging S is applied to the array of containers to maintain the containers in a conveniently handled unit for shipment, storage, and eventual sale.

With further reference to FIG. 1, a supply of filled containers C is provided from a filling machine (not shown) or like device arranged upstream of the present apparatus.

In accordance with the present invention, first and second product streams are formed by the provision of first and second conveyors 14 and 16. An inverting apparatus 18 is operatively associated with the second conveyor 16, and as will be further described, effects inversion of each of the containers in the second product stream.

As further illustrated in FIG. 1, the first and second conveyors are configured such that the first product stream of upright containers C and the second product stream of inverted containers $C_I$ are moved into a generally side-by-side disposition at an indexing area 20. A diverting gate mechanism 22 is positioned immediately downstream of the indexing area 20, and is operated to substantially simultaneously divert the forward-most container in each of the first and second product streams into a pair of further product streams extending to a collating area 24. The streams of now alternately inverted containers are collated into groups having a predetermined number of the containers, with subsequent packaging of each group effected at packaging apparatus 26, preferably through the use of suitable heat-shrink packaging equipment.

Figure 3:
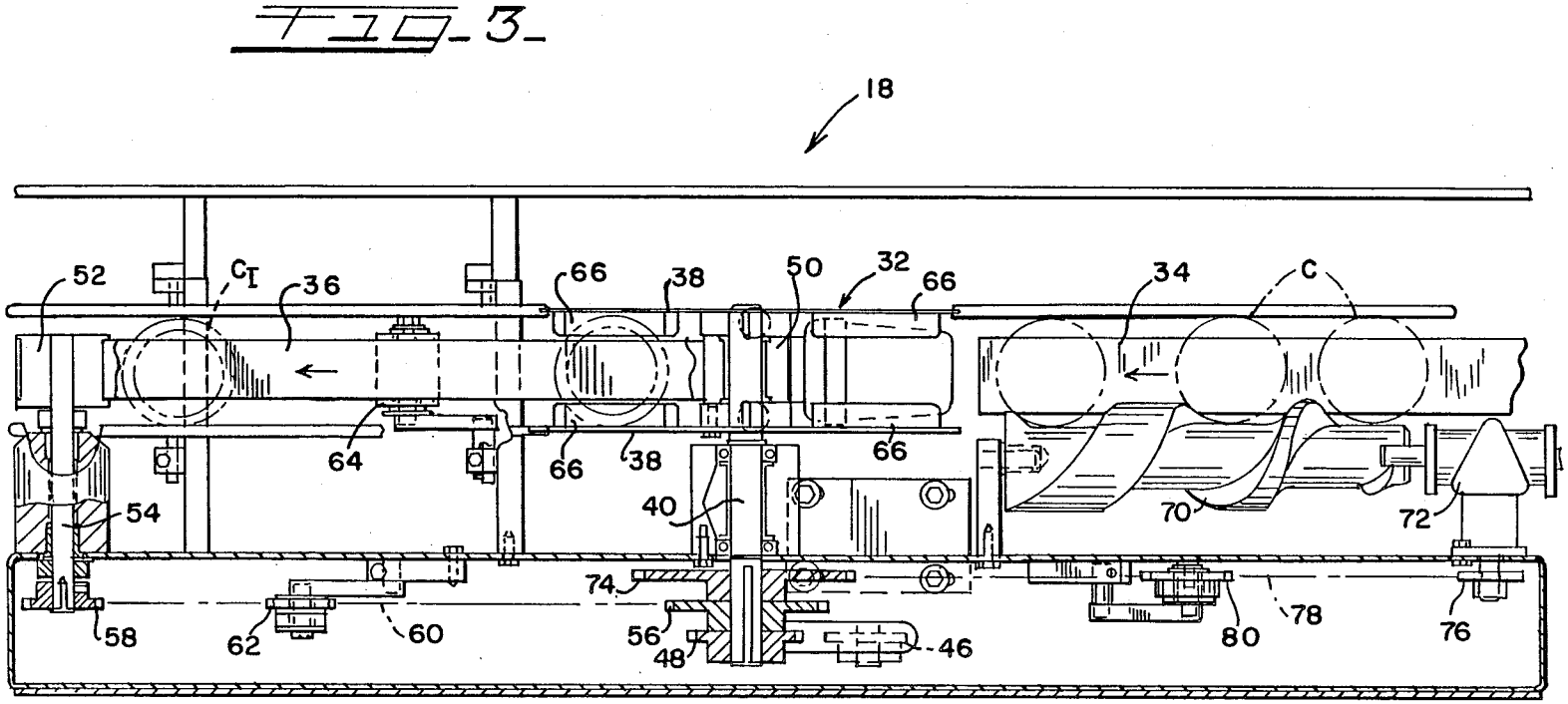
FIG. 3 is a diagrammatic, top plan view, partially cut away and in cross-section, of the container inverting arrangement of the present apparatus, and showing its associated indexing mechanism.
Figure 4:
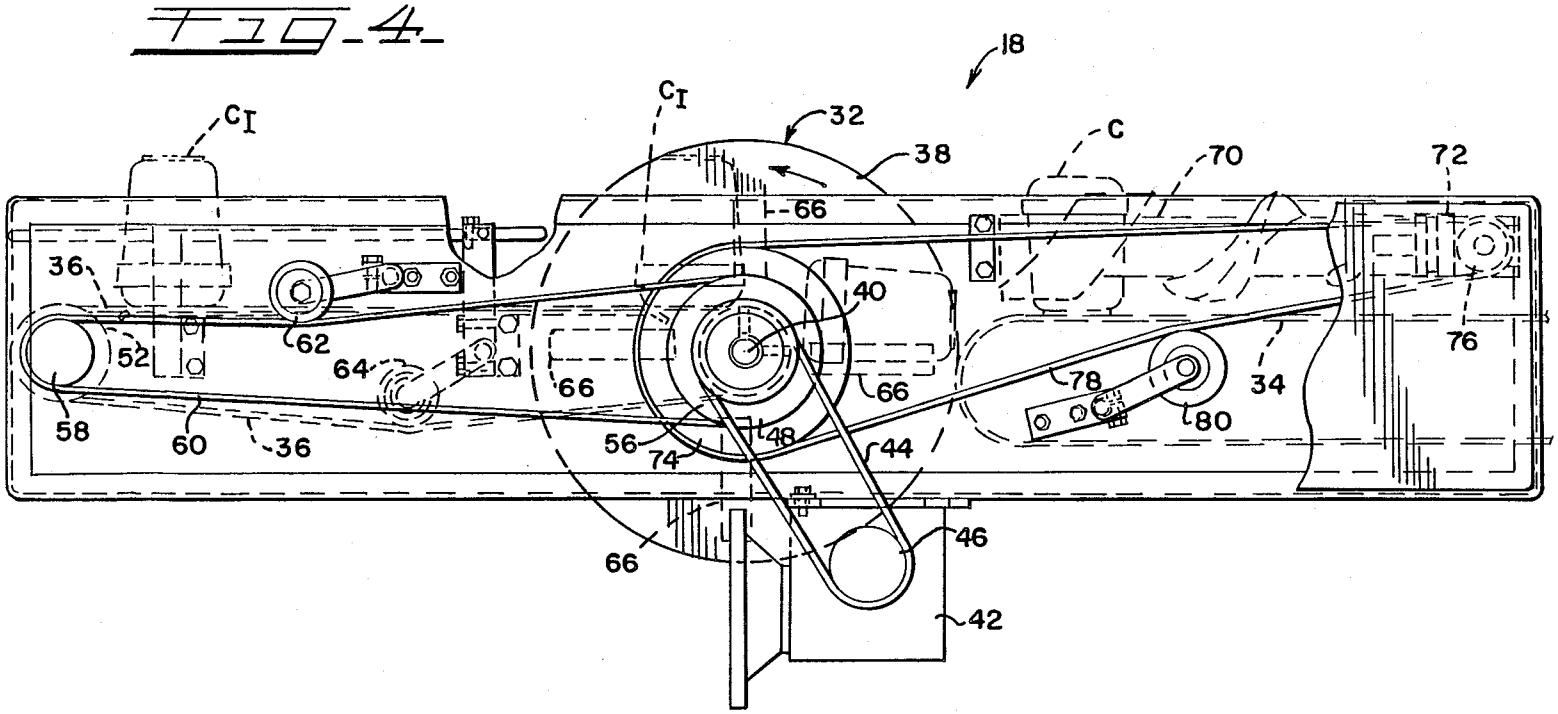
FIG. 4 ls a diagrammatic, side elevational view, partially cut away, further showing the container inverting arrangement of FIG. 3.

With particular reference now to FIGS. 3 and 4, the inverting apparatus 18 associated with the second conveyor 16 will be described. An inverting wheel apparatus 32 is provided generally in operative disposition between an upstream portion of second conveyor 16 provided by conveyor belt 34, and a downstream portion of the second conveyor provided by conveyor belt 36. The containers are conveyed upon upstream belt 34 in an upright disposition, and are inverted and transferred to downstream belt 36 by the inverting wheel apparatus 32.

In the illustrated embodiment, the wheel apparatus 32 includes a pair of spaced apart circular plates 38 which are mounted on a drive shaft 40 for rotation of the wheel apparatus about a horizontal axis. A drive motor 42 (FIG. 4) effects driven rotation of the drive shaft 40, and thus the wheel apparatus, via a drive chain 44, and suitable sprockets 46 and 48 respectively secured to the motor output shaft and the drive shaft 40.

In order to effect the desired transfer of containers to the downstream belt 36, as the containers are inverted, the downstream belt 36 extends about the horizontal rotational axis of the inverting wheel apparatus 32. To this end, the wheel apparatus includes a wheel hub 50 about which the belt 36 is trained, with the belt 36 further trained about a guide roller 52. Wheel hub 50 acts to drive downstream conveyor belt 36 in synchronization with the inverting wheel apparatus, with such synchronous movement of the belt 36 further effected by driven rotation of guide roller 52 by shaft 54 (FIG. 3). The shaft 54 is operatively connected with drive motor 42 by a sprocket 56 keyed to drive shaft 40, a sprocket 58 fixed to shaft 54, and a chain 60 trained about the sprockets 56 and 58. An idler sprocket 62 maintains the desired tension in the chain 60, while a take-up roller 64 in engagement with conveyor belt 36 maintains the desired tension therein.

The inverting wheel apparatus 32 is of a desirably straight-forward configuration, and is configured such that it receives containers from upstream conveyor belt 34 as they move by gravity off of the belt, and inverts and transfers the containers to downstream belt 36. To this end, at least one pair, and preferably a plurality of pairs (four pairs being shown), of container support plates 66 are provided, and are arranged generally radially relative to the axis of rotation of the wheel apparatus. As best shown in FIG. 3, the support plates 66 of each pair are respectively secured to the spaced apart circular plates 38, with the support plates of each pair being spaced from each other by a distance greater than the width of downstream conveyor belt 36. Thus, as each pair of support plates 66 receives a container from upstream conveyor belt 34, the container is carried on its side by the pair of support plates, and is then inverted and placed upon downstream conveyor belt 36 as the support plates pass along side of and below the upper run of the belt 36.

In order to assure that the upright containers C are presented to the inverting wheel apparatus 32 in coordination with rotational movement of the support plates 66, an indexing mechanism is provided immediately upstream of the inverting apparatus. In the illustrated embodiment, an indexing screw 70 is arranged for rotation along an axis generally parallel to upstream conveyor belt 34 generally to one side of the belt. The helical flight of the indexing screw 70 is arranged such that individual ones of the containers C fit between spaced portions of the flight, with the disposition of the indexing screw immediately upstream of the inverting wheel apparatus assuring that the container C are presented to the inverting apparatus at the desired spaced intervals.

Synchronous, driven rotation of the indexing screw 70 is effected via right angle drive 72, which is in turn driven by sprockets 74 and 76 about which chain 78 is trained. Sprocket 74 is driven by drive motor 42 by virtue of disposition of the sprocket 74 on drive shaft 40, with this common drive arrangement for the inverting wheel apparatus, downstream conveyor 36, and indexing screw 70 assuring coordinated and synchronous movement of the various mechanisms. An idler sprocket 70 maintains the desired tension in chain 78.

With reference again to FIG. 1, the manner in which product streams of alternately inverted containers are formed will next be described. As noted, the first product stream of upright container C and the second product stream of inverted containers $C_I$ are directed to an indexing mechanism whereat the product streams are disposed generally side-by-side, with containers next diverted from the respective product streams.

Figure 5:
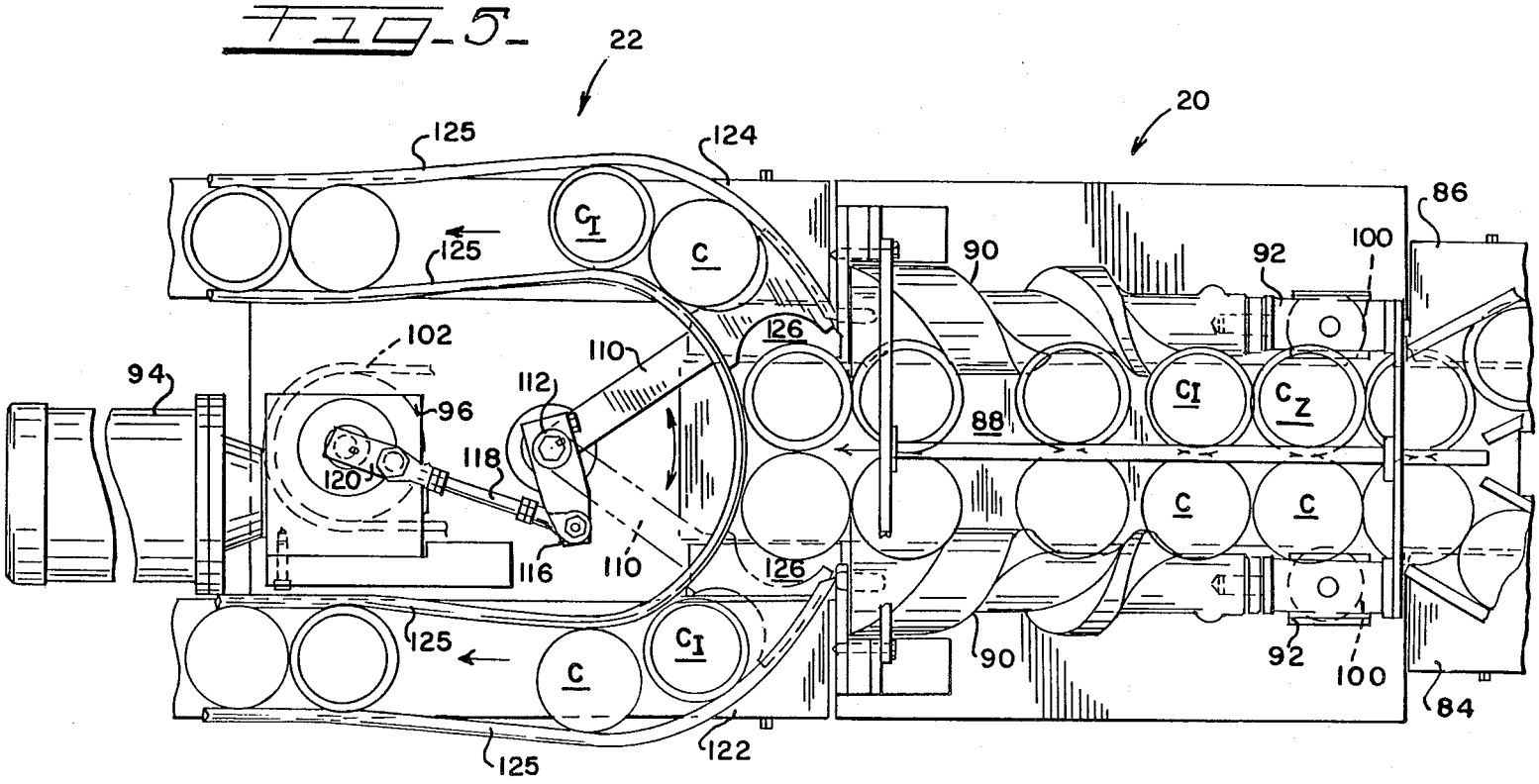
FIG. 5 is a diagrammatic, top plan view of the diverting gate mechanism of the present apparatus, and its associated indexing mechanism.
Figure 6:
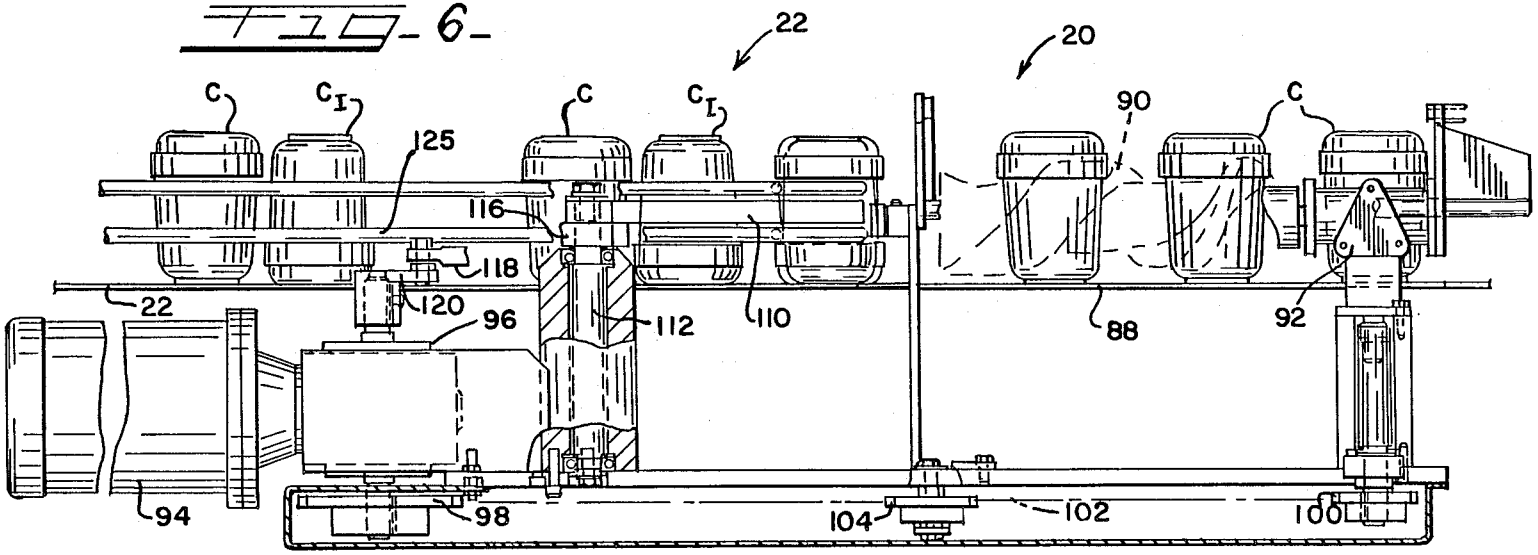
FIG. 6 is a diagrammatic, side elevational view, partially cut away and in cross-section, of the diverting and indexing mechanisms shown in FIG. 5.

Referring particularly to FIGS. 5 and 6, the first product conveyor 14 terminates in a first feed conveyor belt 84, with the second product conveyor 16 terminating in a second feed conveyor belt 86 (FIG. 5). Suitable fixed guide members guide and transfer the upright conveyors C from conveyor belt 84 and the inverted containers $C_I$ from the second conveyor belt 86 to a common indexing conveyor 88.

A pair of indexing screws 90 are provided immediately upstream of the diverting gate mechanism 22, and are arranged for opposite, concurrent rotation on respective horizontal axes parallel to indexing conveyor 88 to present the containers to the gate mechanism 22 at the desired spaced intervals. Synchronous drive of the indexing screws 90 is effected by respective right angle drives 92, which are in turn driven by a common drive motor 94 operating through a suitable gear reducer 96. With particular reference to FIG. 6, a drive sprocket 98 fitted to gear reducer 96 drives sprockets 100, in turn respectively connected to right angle drives 92, via chain 102. A pair of idler sprockets 104 (one being shown) guide the chain 102 between sprockets 98 and 100.

As the first and second product streams of containers pass through the indexing mechanism 20, the containers are presented to a pivotally reciprocating diverting gate 110. The arm-like gate 110 reciprocates so as to divert the forward-most container of each product stream in a first direction, and then divert the next forward-most containers of the streams in a second direction generally opposite the first direction. A pair of further product streams are thus formed by this sweeping-like action, wherein the containers of each stream are alternately inverted. Notably, the manner in which the forward-most containers of the first and second product streams are diverted on each opposite, reciprocating stroke of the gate 110 results in the containers of each resultant product stream being alternately inverted in an order opposite that of the other stream.

As best illustrated in FIG. 6, the gate 110 is mounted for pivotally reciprocating movement by a vertical support shaft 112. As best shown in FIG. 5, a crank arm 116 fixed to shaft 112 is operatively connected with a connecting rod 118. Connecting rod 118 is in turn operatively connected with another crank arm 120 which is rotatably driven by drive motor 94 via gear reducer 96. As will be appreciated, this common drive arrangement desirably coordinates the reciprocating movement of gate 110 with the driven rotational movement of indexing screws 90. The product streams formed by the reciprocating gate mechanism are diverted from indexing conveyor 88 to a pair of collating feed conveyors 122 and 124. Relatively fixed guide rails 125 assist in guiding the movement of the containers, with a pair of transfer plates 126 preferably operatively positioned between indexing conveyor 88 and each of the collating feed conveyors 122 and 124.

Referring again to FIG. 1, it will be appreciated that the two streams of alternately inverted containers are in the desired form for collating into the predetermined number of containers which will be grouped for subsequent packaging. Suitable stop mechanisms 128 and 130 are provided in the collating area 124, with the desired array of alternately inverted containers thus formed. Suitable operation of the stop mechanisms facilitates formation of each array of containers, and subsequent movement of the containers to the packaging apparatus 26 for heat-shrink packaging of each array.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

We claim:

1. A method of forming a package of alternately inverted containers, comprising the steps of:

providing a supply of said containers;

forming said supply of containers into first and second product streams of said containers;

inverting each of the containers in said second product stream;

arranging said first product stream and said second, inverted product stream in a generally side-by-side disposition, and substantially simultaneously diverting the forward-most container of each of said first and second product streams to form at least one further product stream having alternately inverted ones of said containers;

collating a predetermined number of the alternately inverted containers in said further product stream to form an array of said containers; and packaging said collated group of containers to form said package.

2. A method of forming a package of alternately inverted containers in accordance with claim 1, including forming a pair of said further product streams each having alternately inverted ones of said containers by diverting the forward-most container of each of said first and second product streams in a first direction to form one of said further streams, and by diverting the next foward-most container of each of said first and second product streams in a second direction generally opposite said first direction to form the other of said product streams, wherein the containers in each further stream are alternately inverted in an order opposite that of the other further stream.

3. A method of forming a package of alternately inverted containers in accordance with claim 2, wherein said diverting comprises providing reciprocating, diverting gate means for substantially simultaneously diverting the forward-most containers of each of said generally side-by-side first and second product streams.

4. A method of forming a package of alternately inverted containers, comprising the steps of:

providing a supply of said containers;

forming said supply of containers into first and second product streams of said containers;

inverting each of the containers in said second product stream;

forming a pair of further product streams each having alternately inverted ones of said containers by diverting containers from each of said first and second product streams;

collating a predetermined number of the alternately inverted containers in said further product stream to form an array of said containers; and packaging said collated group of containers to form said package.

5. A method of forming a package of alternately inverted containers in accordance with claim 4, wherein said pair of further product streams are formed so that the containers in each further stream are alternately inverted in an order opposite that of the other further stream, said collating step including forming said group of containers in a side-by-side array from said oppositely, alternately inverted pair of further streams, such that adjacent containers of said array are relatively inverted 6. An apparatus for forming a package of alternately inverted containers, comprising:

first and second conveyor means for respectively conveying first and second product streams of said containers;

container inverting means operatively associated with said second conveyor means for inverting each of the containers in said second product stream;

diverting means for diverting containers from each of said first and second product streams for forming a pair of further product streams each having alternately inverted ones of said containers, wherein the containers of each further stream are alternately inverted in an order opposite that of the other further stream;

collating means for collating a predetermined number of the alternately inverted containers in said further product stream to form an array of said containers; and packaging means for packaging said collated array of containers to form said package.

7. An apparatus for forming a package of alternately inverted containers in accordance with claim 6, wherein said second conveyor means comprises a portion upstream of said container inverting means on which said containers are conveyed in an upright disposition, and a portion downstream of said inverting means on which said containers are conveyed in an inverted disposition, said container inverting means comprising inverting wheel means rotatable about a horizontal axis, said inverting wheel means including container support means which receive each said container from said upstream portion of said second conveyor means, and which transfers each said container to said downstream portion of said second conveyor means in a substantially inverted disposition.

8. An apparatus for forming a package of alternately inverted containers in accordance with claim 7, wherein said container support means comprises at least one pair of spaced apart support plates arranged generally radially relative to the axis of rotation of said inverting wheel means, said downstream portion of said second conveyor means including a conveyor belt extending about the axis of rotation of said inverting wheel means, said support plates being spaced from each other by a distance greater than the width of said conveyor belt.

9. An apparatus for forming a package of alternately inverted containers in accordance with claim 7, including indexing means immediately upstream of said inverting wheel means for presenting the containers on said upstream portion of said second conveyor means to said inverting wheel means at spaced intervals.

10. An apparatus for forming a package of alternately inverted containers, comprising:

first and second product conveyor means for respectively conveying first and second product streams of said containers;

container inverting means operatively associated with said second conveyor means for inverting each of the containers in said second product stream;

diverting means for diverting containers from each of said first and second product streams for forming at least one further product stream having alternately inverted ones of said containers;

collating means for collating a predetermined number of the alternately inverted containers in said second product stream to form an array of said containers; and packaging means for packaging said collated array of containers to form said package, wherein said first and second conveyor means are disposed in generally side-by-side disposition immediately upstream of said diverting means, said diverting means comprising diverting gate means for substantially simultaneously diverting the forward-most one of the containers of each of said first and second product streams for forming said further product stream with alternately inverted ones of said containers.

11. An apparatus for forming a package of alternately inverted containers in accordance with claim 10, including indexing means immediately upstream of said diverting gate means for presenting said containers in said first and second product streams to said diverting gate means at spaced intervals.

12. An apparatus for forming a package of alternately inverted containers in accordance with claim 10, wherein said diverting gate means is arranged for pivotally reciprocating movement.

* * * * *